US005639209A

United States Patent [19]

Pollini et al.

[11] Patent Number: 5,639,209

[45] Date of Patent: Jun. 17, 1997

[54] ROTOR FOR THERMAL TURBOMACHINES

[75] Inventors: Claudio Pollini, Uster; Cornelis Strizenou, Nussbaumen, both of Switzerland

[73] Assignee: Asea Brown Boveri AG, Baden, Switzerland

[21] Appl. No.: 670,773

[22] Filed: Jun. 20, 1996

[30] Foreign Application Priority Data

Aug. 25, 1995 [DE] Germany ..... 195 31 290.2

[51] Int. Cl.[6] ..... F01D 5/14

[52] U.S. Cl. ..... 415/116

[58] Field of Search ..... 415/115, 116; 416/204 R, 204 A, 213 R

[56] References Cited

U.S. PATENT DOCUMENTS

| | | | |
|---|---|---|---|
| 4,795,307 | 1/1989 | Liebl | 415/116 |
| 5,020,932 | 6/1991 | Boyd | 416/244 A |
| 5,054,996 | 10/1991 | Carreno | 415/116 |
| 5,271,711 | 12/1993 | McGreehan et al. | 415/116 |

FOREIGN PATENT DOCUMENTS

| | | |
|---|---|---|
| 0318026A1 | 5/1989 | European Pat. Off. . |
| 10538 | 6/1956 | Germany . |
| 2633829C2 | 3/1984 | Germany . |

*Primary Examiner*—John T. Kwon

*Attorney, Agent, or Firm*—Burns, Doane, Swecker & Mathis

[57] ABSTRACT

In a rotor (1) for thermal turbomachines, in particular a compressor part (2), center part (3) and turbine part (4) arranged on one shaft, the rotor (1) mainly consisting of individual rotary bodies welded to one another, the geometrical form of which leads to the formation of axially symmetrical hollow spaces (5) between the respectively adjacent rotary bodies, there are provided a further, cylindrical hollow space (7) extending around the center axis (6) of the rotor (1) and reaching from the downstream end of the rotor (1) up to the last hollow space (**5*h*) upstream and at least two tubes (8, 9) having different diameters and lengths from one another, which tubes (8, 9) overlap at least partly and are placed in the cylindrical hollow space (7), in which arrangement the tubes (8, 9) are each firmly anchored to at least one fixed point and the fixed points of the tubes (8, 9) lie at axially different locations. The tubes (8, 9) are each provided with at least two through-openings (13) in the circumference, at least one opening (13) being arranged in the turbine part (4) and at least one opening (13) being arranged in the compressor part (2) or center part (3), and the openings (13) in the different tubes (8, 9) overlapping in the turbine part (4) in the hot operating state, whereas they overlap in the compressor part (2) and center part (3**) in the cold state.

7 Claims, 3 Drawing Sheets

ROTOR FOR THERMAL TURBOMACHINES

BACKGROUND OF THE INVENTION

1. Field of the Invention

The invention relates to a rotor of hollow design in its interior for thermal turbomachines.

2. Discussion of Background

It is known to construct rotors for steam and gas turbines, compressors and turbogenerators from individual rotary bodies having hollow spaces. DE 26 33 829 C2, for example, discloses rotors which are constructed from disk-shaped or hollow-cylindrical forgings, the individual disks or drums (hollow cylinders) in the center part of the rotor preferably having a constant thickness. In this arrangement, the disks or drums are connected to one another by means of low-volume welds.

In order to keep, for example, the operating temperatures of gas turbine rotors approximately constant during full-load operation, these gas turbine rotors must be cooled. For this purpose, it is conventional practice to introduce cooling air through the exhaust-gas-side shaft end into the rotor. There is therefore a central bore in the rotor, which central bore extends from the exhaust-gas-side shaft end up to the last turbine disk. This bore forms the rotor cooling-air duct. The cooling air is extracted from a certain compressor stage and is introduced via a special pipeline into the central bore at the exhaust-gas-side end of the rotor, the transition of pipeline/rotor being sealed off with labyrinth seals. The cooling air flows through the rotor cooling-air duct and then through the hollow space between the two turbine disks before it passes the turbine blades or passes through radial hollow spaces to the rotor surface and mixes with the exhaust-gas flow.

With this known arrangement, although cooling of the rotor is possible once full-load operation is reached, so that small blade clearances and high efficiencies are thereby realizable, positive influencing of the rotor under transient operating conditions, which are especially critical on account of the different thermal behavior of rotor and stator, is not possible.

SUMMARY OF THE INVENTION

Accordingly, one object of the invention, in attempting to avoid this disadvantage, is to design a novel rotor of a turbomachine in such a way that it reaches its operating state in the shortest time and it can easily be thermally regulated, i.e. can be heated or cooled according to requirement with relatively little effort.

According to the invention, this is achieved in a rotor according to the preamble of claim 1 when a further, cylindrical hollow space extending around the center axis of the rotor and reaching from the downstream end of the rotor up to the last hollow space upstream is provided, and when at least two tubes having different diameters and lengths from one another and overlapping at least partly to a certain length are placed in the cylindrical hollow space, in which arrangement the tubes are each firmly anchored to at least one fixed point, the fixed points of the tubes lie at axially different locations, and the tubes are provided with a plurality of holes distributed over the length, the holes of the different tubes at least partly overlapping.

The advantages of the invention consist in the fact that the rotor can alternatively be heated or cooled during different operating conditions, it reacts very quickly and the rotor cooling air can continue to be used in the machine, for example for cooling the roots of the turbine blades.

It is especially expedient if the rotor on the one hand and the tubes on the other hand are made of different material having as large a difference as possible between the coefficients of thermal expansion. The regulation can then be carried out in an especially effective manner.

Furthermore, it is advantageous if the holes are arranged in a distributed manner over the periphery of the tubes and the holes in the tube having the smaller periphery are provided with grooves at the outside diameter. Consequently, accurate adjustment of the tubes when fitting them into the rotor is not necessary.

In addition, it is expedient if the diameter of the cylindrical hollow space is larger in the region between the first and the last hollow space than the outside diameter of the tube having the largest periphery, a means for sealing off the center part from the turbine part, for example a centering piece of special design, being arranged on this tube, which means comes into effect as a sealing means only in the hot operating state. The throughflow of the air is thereby ensured in addition to the abovementioned advantages.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

Only the elements essential for understanding the invention are shown. Not shown are, for example, the moving blades and the bearings of the rotor as well as the blade carrier, the combustion chamber and the exhaust-gas casing of the gas turbine. The direction of flow of the air is designated by arrows.

DESCRIPTION OF THE PREFERRED EMBODIMENTS

Figure 1:
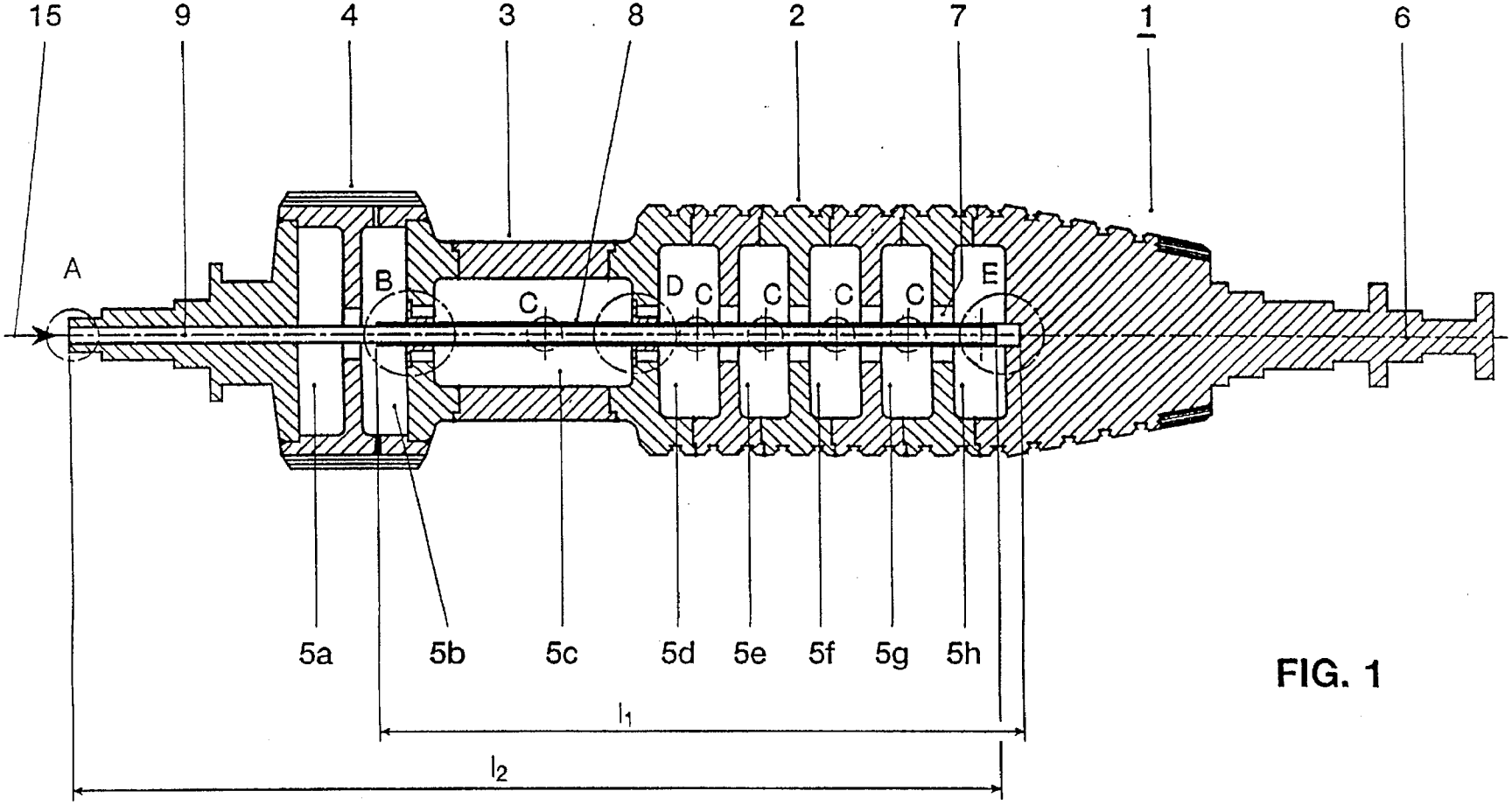
FIG. 1 shows a longitudinal section of the rotor.

Referring now to the drawings, wherein like reference numerals designate identical or corresponding parts throughout the several views, FIG. 1 shows a longitudinal section of a rotor 1 according to the invention of a single-shaft axial-flow gas turbine. The rotor 1 consists of a compressor part 2, a center piece 3 and a turbine part 4. It is constructed from individual rotary-body-shaped disks by means of a low-volume weld according to DE 26 33 829 C2. These disks define a plurality of rotationally symmetrical hollow spaces 5*a* to 5*h*, eight in this exemplary embodiment, in the interior of the rotor 1, the hollow spaces 5*a* and 5*b* being located in the turbine part 4, the hollow space 5*c* being located in the center part 3 and the hollow spaces 5*d* to 5*h* being located in the compressor part 2. The cylindrical hollow space 7 extending around the rotor axis 6 over almost the entire length has a greater diameter $d_{H1}$ in the region between the first and last hollow space 5*a*, 5*h*, that is in the region between the first compressor disk and the second, here the last, turbine disk, than in the region from the last turbine disk up to the downstream end of the rotor 1 ($d_{H2}$).

Two tubes 8, 9 having a different diameter and different length from one another are arranged in the cylindrical hollow space 7. The shorter tube 8 having a length 11 and an inside diameter $d_{1i}$ is firmly fixed at the compressor-side end of the hollow space 7 to the compressor part 2 of the rotor 1, whereas the longer tube 9 having a length 12 and an outside diameter $d_{2a}$ is firmly fixed to the other end of the hollow space 7, that is to the exhaust-gas-side end of the turbine 4. The following approximation applies: $d_{H2}=d_{2a}=d_{1i}$.

Enlarged partial longitudinal sections of the tubes 8, 9, which have the function of regulating rods, are shown in various regions of the rotor 1 in FIGS. 2 to 6. The top part of the drawing in each case illustrates the cold state and the bottom part of the drawing illustrates the hot state.

Figures 2, 3, 4, 5, 6:
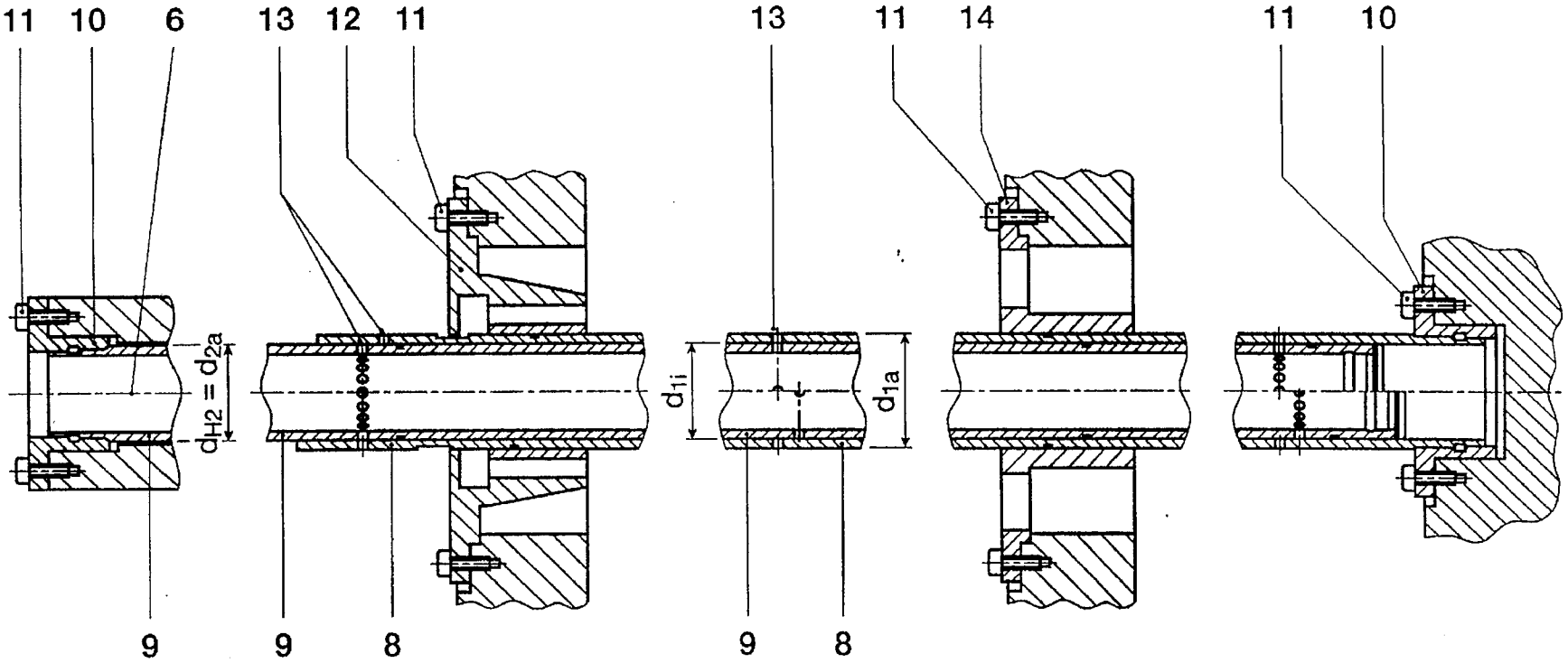
FIG. 2 shows an enlarged partial longitudinal section in the region A of FIG. 1.
FIG. 3 shows an enlarged partial longitudinal section in the region B of FIG. 1.
FIG. 4 shows an enlarged partial longitudinal section in the region C of FIG. 1.
FIG. 5 shows an enlarged partial longitudinal section in the region D of FIG. 1.
FIG. 6 shows an enlarged partial longitudinal section in the region E of FIG. 1.

FIG. 2 shows the exhaust-gas-side end of the rotor 1 in the region A of FIG. 1. The tube 9 is firmly connected to the rotor 1 by means of a screwed-on flange 10 via screws 11. In this region there is only one tube, namely the tube 9, in the interior of the rotor 1.

There are different features in the region B (FIG. 3). The two tubes 8 and 9 overlap in this region (transition from the center part 3 to the turbine part 4). In addition, a means 12 for sealing off the center part 3 from the turbine part 4 is attached here to the outer tube 8, which means 12 comes into effect only in the hot operating state for the purpose of sealing. The means 12 is a centering piece which is screwed together with the rotor 1 via screws 11. The centering piece serves at the same time as a regulating piece by allowing air to pass through unimpeded in the cold state and by sealing off the center part 3 and the turbine part 4 from one another in the hot state.

The tubes 8, 9 have openings 13 distributed over the periphery, the openings 13 being at different locations of the axial length in the region B in the cold state, whereas they overlap precisely in the hot state and thus form a through-opening 13.

FIG. 4 shows the two tubes 8, 9 in each case in the center of the hollow spaces 5*c* to 5*g*, that is in the region C. Here, the bores 13 are made in the tubes 8, 9 in such a way that they lie exactly one above the other in the cold state of the plant and thus form a through-opening 13. In the hot state, on the other hand, the openings 13 are offset from one another.

FIG. 5 shows the region D. This is the transition from the compressor part 2 to the center part 3. In this region there are no bores 13 in the tubes 8, 9. A further centering piece 14 has been pushed over the tubes 8, 9 here, which centering piece 14 is firmly connected to the compressor part 2 by means of screws 11. The centering piece 14 serves as a support for the tubes 8, 9.

FIG. 6 shows the region E, that is the region in which the tube 8 having the larger diameter is fastened to the compressor part 2. The tube 8 is screwed together with a flange 10 against a stop and is fastened to the compressor rotor 2 by screws 11. The tubes 8, 9 may of course also be fixed in another manner in other exemplary embodiments, e.g. by means of welding, shrinking or clamping.

The mode of operation of the thermal regulation is as follows:

During starting of the gas turbine, that is in the cold state, the rotor 1 has to be heated so that it reaches its operating state as quickly as possible. For this reason, air 15 is extracted from a certain compressor stage and is directed at the downstream end of the rotor 1 into the hollow space 7 of the rotor. Since the two tubes 8, 9 and the rotor 2 are still cold, the openings 13 in the tubes 8 and 9 in the region of the turbine (region B, FIG. 3, top part) are offset from one another, whereas they overlap in the regions C and E, that is in the compressor part 2 and in the center part 3, and thus form a through-opening 13. This means that the air 15 flows along in the tube 9 from the downstream end of the rotor 1 across the turbine part 4 and is directed via the six openings 13 in this exemplary embodiment in the regions C and E (see FIGS. 1, 4 and 6) into the compressor space. From there it passes through the entire rotor and is then used for cooling the turbine blades.

The rotor 1 is now uniformly heated and expands, as do the tubes 8, 9 acting as regulating rods. Since there should be quite a difference between the coefficients of thermal expansion of the rotor 1 and the regulating rods 8, 9 for the purpose of effective regulation, weldable steel is selected as the material for the rotor 1 and aluminum or plastic is selected for the tubes 8, 9.

If the rotor is now to be cooled in the hot state, the air 15 is only directed into the turbine part 4 so that it only has to cool the turbine region. This regulation takes place thermally, since the openings 13 in the two tubes 8, 9 in the regions C and E are now offset from one another on account of the thermal expansion of the two tubes 8, 9, which acts in opposite directions on account of the respective fixing at different locations, whereas in the region B the openings 13 are superimposed so that the air 15 passes without problem through these through-openings into the turbine part 4 (see FIG. 3, bottom part).

The tubes 8, 9 need not match one another in angle, since the tubes are provided with grooves at the through-holes. In addition, heat-resistant seals which also serve to stabilize the tubes 8, 9 are provided at various locations (not shown in the figures).

The rotor 1 must be assembled in a certain sequence:

1. The regulating rod (tube 8) of larger diameter is screwed together with the flange 10 against a stop and secured. The tube 8 is then fastened by screws 11 to the compressor rotor and likewise secured. It must now be supported.
2. The individual compressor-rotor disks are then welded together individually with the rotor piece.
3. The centering piece 14 is now pushed over the tube 8 and fastened to the compressor disk by means of screws 11.
4. The center part 3 and the first turbine disk are now welded together with the rotor.
5. A further centering piece 12 which also serves as a regulating piece is then pushed over the tube 8 and screwed together with the rotor.
6. After that the remaining rotor parts are welded together.
7. Finally, the second tube 9 is fitted into the rotor 1 and screwed to the rotor 1 with the screwed-on flange 12.

The invention has a number of advantages. Simple thermal regulation of the rotor is effected, in the course of which the cooling air continues to be used in the turbine, through-flow of the air occurs and the rotor reacts effectively.

Figure 7:
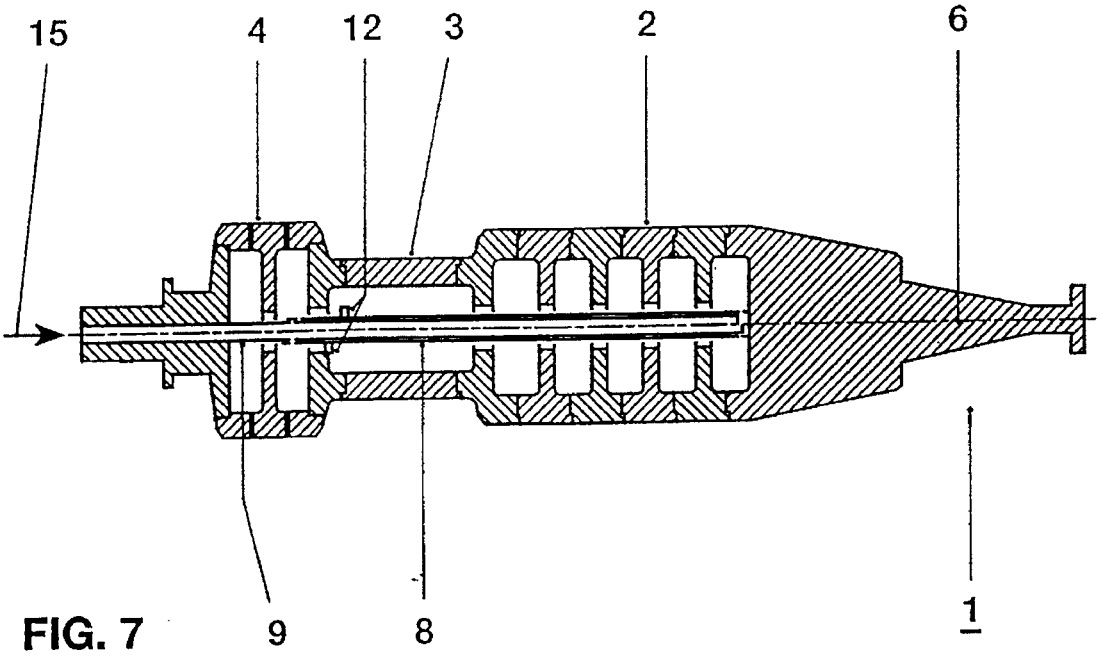
FIG. 7 shows a longitudinal section of the rotor of a second exemplary embodiment.

FIG. 7 shows a further exemplary embodiment, the top part of the drawing again showing the cold state of the rotor and the bottom part the hot state. It differs from the first exemplary embodiment only in that the outer tube 8 only has an opening 13 in the turbine part 4 and the compressor part 2 respectively and the inner tube 9 only has an opening 13 in the turbine part 4, and in the cold state only the opening 13 in the compressor part 2 allows the air 15 to pass through, which then flows via the hollow spaces 5 into the center part 3 and then into the turbine part 4 and finally to the turbine blades (not shown). In the hot state (see bottom part of the drawing), the opening 13 in the compressor part 2 is closed by the thermal expansion which has taken place, whereas the openings 13 in the turbine part 4 overlap and therefore form a passage for the cooling air. The shut-off member 12 fastened to the tube 8 prevents air from flowing into the center or compressor part 2, 3 in the hot state.

Figure 8:
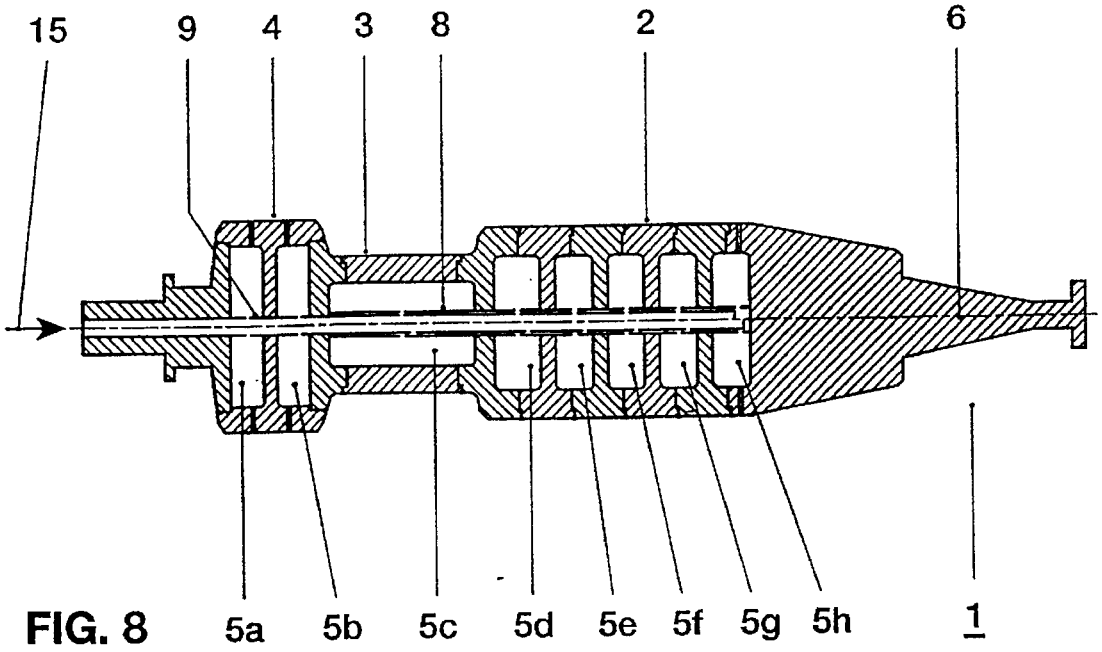
FIG. 8 shows a longitudinal section of the rotor of a third exemplary embodiment.

Compared with the examples described above, the embodiment variant shown in FIG. 8, as a result of the adaptation of the diameter of the cylindrical central hollow space 7 to the diameters of the tubes 8, 9, has the disadvantage that the air in the center part 3 and in the compressor part 2 of the rotor 1 is no longer transmitted (except in region 5*h*). Although this air can be discharged from the rotor 1, e.g. through additional openings in the center part 3 and in the compressor part 2, this leads to high losses.

The invention is of course not restricted to the exemplary embodiments shown here. It may also be applied to other turbomachines, for example steam turbines and turbochargers.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A rotor for thermal turbomachines, including a compressor part, center pan and turbine pan arranged on one shaft, the rotor comprising individual rotary bodies welded to one another, the geometrical form of which leads to the formation of axially symmetrical hollow spaces between the respectively adjacent rotary bodies, wherein a) a cylindrical hollow space extending around the center axis of the rotor and reaching from the downstream end of the rotor up to the last hollow space upstream is provided, b) at least two tubes having different diameters and lengths from one another and at least partly overlapping are placed in the cylindrical hollow space, c) the tubes are each firmly anchored to at least one fixed point, d) the fixed points of the tubes lie at axially different locations, e) the tubes are each provided with at least two through-openings in the circumference, at least one opening being arranged in the turbine part and at least one opening being spaced from the opening in the turbine part, and f) the openings in the different tubes overlap in the turbine pan in the hot operating state, whereas they overlap in the compressor part and center part in the cold state.

2. The rotor as claimed in claim 1, wherein the rotor on the one hand and tubes on the other hand are made of different material having different coefficients of thermal expansion.

3. The rotor as claimed in claim 1, wherein the holes are in each case arranged in a distributed manner over the periphery of the tubes.

4. The rotor as claimed in claim 3, wherein the holes in the tube having the smaller periphery are provided with grooves at the outside diameter.

5. The rotor as claimed in claim 1, wherein the diameter of the cylindrical hollow space is larger in the region between the first and the last hollow space than the outside diameter of the tube having the largest periphery, and wherein a means for sealing off the center part from the turbine part is arranged on at least one of the tube and the rotor, which means seals off the center part from the turbine part only in the hot operating state.

6. The rotor as claimed in claim 1, wherein said at least one opening spaced from the opening in the turbine pan is arranged in the compressor part.

7. The rotor as claimed in claim 1, wherein said at least one opening spaced from the opening in the turbine part is arranged in the center part.

* * * * *